US010132115B2

(12) United States Patent
Hall et al.

(10) Patent No.: US 10,132,115 B2
(45) Date of Patent: Nov. 20, 2018

(54) HEADRAIL OF A WINDOW COVERING WITH SAFETY DEVICE FOR AUTOMATICALLY ADJUSTING THE HEADRAIL MOUNTING

(71) Applicants: David R. Hall, Provo, UT (US); Emily Brimhall, Alpine, UT (US); Austin Carlson, Provo, UT (US); Terrece Pearman, Draper, UT (US)

(72) Inventors: David R. Hall, Provo, UT (US); Emily Brimhall, Alpine, UT (US); Austin Carlson, Provo, UT (US); Terrece Pearman, Draper, UT (US)

(73) Assignee: Hall Labs LLC, Provo, UT (US)

( * ) Notice: Subject to any disclaimer, the term of this patent is extended or adjusted under 35 U.S.C. 154(b) by 94 days.

(21) Appl. No.: 15/450,991

(22) Filed: Mar. 6, 2017

(65) Prior Publication Data

US 2018/0252029 A1 Sep. 6, 2018

(51) Int. Cl.

| | |
|---|---|
| ***E06B 9/24*** | (2006.01) |
| ***E06B 9/68*** | (2006.01) |
| ***E06B 9/266*** | (2006.01) |

(52) U.S. Cl.

CPC ..... *E06B 9/266* (2013.01)

(58) Field of Classification Search

None

See application file for complete search history.

(56) References Cited

U.S. PATENT DOCUMENTS

| | | | | |
|---|---|---|---|---|
| 5,899,424 | A * | 5/1999 | Williams, Jr. | E06B 9/323 248/262 |
| 6,709,039 | B1 * | 3/2004 | Davenport | B60R 5/047 160/323.1 |
| 6,834,705 | B2 * | 12/2004 | Seel | B60J 1/2019 160/370.22 |
| 2001/0045001 | A1 * | 11/2001 | Hunter | B23P 19/006 29/525 |

* cited by examiner

*Primary Examiner* — Bentsu Ro

(57) ABSTRACT

We disclose a headrail for window coverings that may include an extensible end cap and a gearbox which automatically adjusts the headrail mounting. The extensible end cap may include a mounting bracket which may be connected to a piston. The piston may be connected to a floating bearing. The gearbox may include a motor-driven main gear which rotates a threaded rod. As the threaded rod rotates, an end of the threaded rod may move toward a floating bearing. The floating bearing may apply force the piston which may transmit the force to the mounting bracket. The extensible end cap may also include a sensor which detects the amount of pressure or force applied to the mounting bracket. When the sensor collects a measurement below a defined level, the motor may actuate the main gear to rotate the threaded rod and apply additional force to the mounting bracket.

20 Claims, 8 Drawing Sheets

HEADRAIL OF A WINDOW COVERING WITH SAFETY DEVICE FOR AUTOMATICALLY ADJUSTING THE HEADRAIL MOUNTING

BACKGROUND

Field of the Invention

This disclosure relates to headrails used in window coverings, specifically intelligent window coverings.

Background of the Invention

Window coverings may be mounted in a window or door frame by mounting the headrail of the window covering within the window or door frame. In some window coverings, the headrail is mounted by extending a section of an end cap within the headrail to apply force to the window or door frame. Over time, the mechanical parts of these end caps, which may include springs, may lose their strength. Alternatively, parts within the end cap may slip out of place. In either situation, the end cap may gradually apply less force to the window or door frame. This may cause the headrail to slip and be in danger of falling.

While some window covers may provide means for checking the mounting of the headrail, most users do not regularly check their window coverings. Even when the user does regularly check the headrail mounting, this is an inconvenient task and does not assure that the headrail mounting will loosen between mounting assessments. A window covering is needed which detects when the force required to keep the headrail in place automatically adjusts to maintain proper headrail mounting.

BRIEF SUMMARY OF THE INVENTION

We disclose a headrail for a window covering that may sense the stability of the headrail and automatically adjust the headrail mounting in order to prevent the headrail from falling. The headrail may include a motorized mechanical system that may hold the headrail in place in a window frame or door frame. The headrail may include an extensible end cap which may include a mounting bracket. The mounting bracket may exert pressure on the window frame from one or both ends of the headrail. A piston within the extensible end cap may transmit force to the mounting bracket from a floating bearing. The extensible end cap may also include a sensor that detects how much force or pressure is applied to the end cap system in order to maintain the headrail mounting. In some embodiments, the sensor may be either a pressure sensor and a force sensing resistor.

The headrail also includes a gearbox which may adjust the headrail mounting when the sensor collects a measurement that suggests the mounting is beginning to fail. The gearbox may include a motor which is coupled to a main gear. The motor may cause the main gear to rotate. Some embodiments also include one or more additional stages of gears. The additional stages of gears may be mechanically coupled to the main gear and may function to reduce the gear ratio of the motor. The gearbox may also contain a threaded rod with an external thread. The external threads may mesh with the external teeth of the main gear such that the threaded rod rotates as the motor actuates the main gear. When the threaded rod rotates, it may move linearly toward a floating bearing within the extensible end cap and may cause the threaded rod to apply force on the floating bearing. This force is transmitted through the piston within the extensible end cap, causing the piston to compress against the mounting bracket. The mounting bracket becomes more tightly pressed against the window frame or door frame. The headrail mounting is thereby tightened making a more secure mounting.

In some embodiments, the threaded rod includes a base and a connector on the end of the threaded rod. The base may be slidably connected to a track within the gearbox. The base may slide along the gearbox as the threaded rod moves toward or away from the floating bearing to stabilize the threaded rod as it moves forward and back.

In some embodiments, the gearbox includes a battery. The battery may provide power to the motor. In other embodiments, the battery may be positioned outside of the gearbox and wired to connect electrically to the motor. The gearbox may also include a controller. The controller may be electrically connected to both the sensor and to the motor. The controller may include a memory that includes program code which may be used to modify the functions of the gearbox.

DETAILED DESCRIPTION OF THE INVENTION

Definitions

Figure 1A:
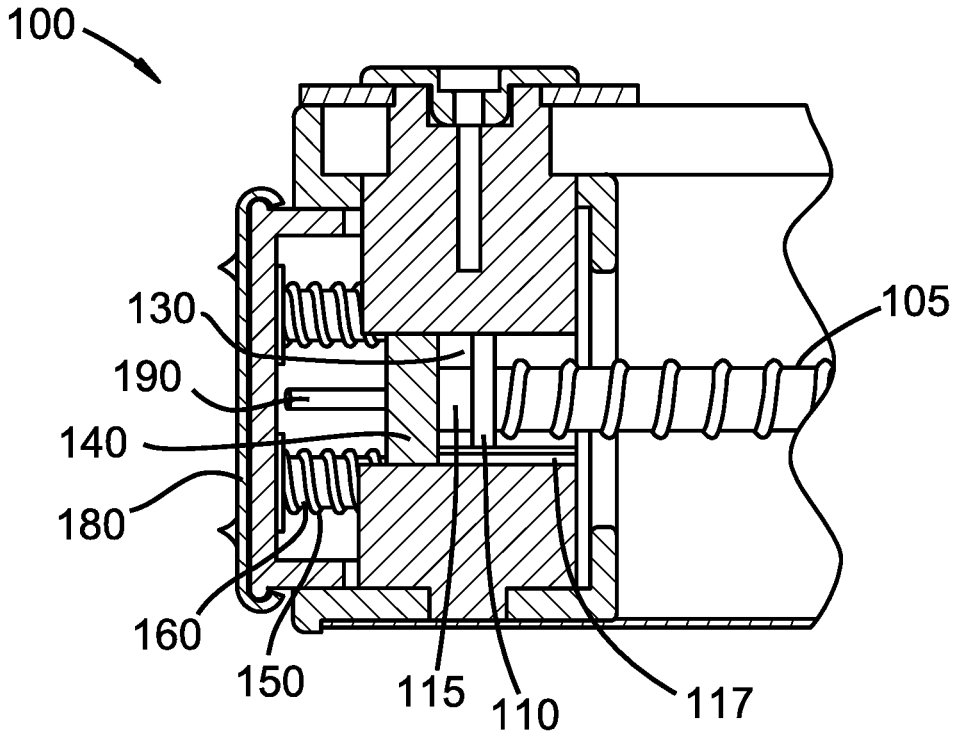
FIG. 1A illustrates a perspective view of a cross-section of an embodiment of an extensible end cap with the piston in a retracted position and with the threaded rod, base, and connector shown.

Window covering, as used herein, means a blind or shade that covers an opening in a building, including a window or door.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

We disclose a headrail for a window covering that may sense the stability of the headrail and automatically adjust in order to prevent the headrail from falling.

The headrail may include an extensible end cap including the embodiments disclosed in U.S. patent application Ser. No. 15/436,284, filed on Feb. 17, 2017 which is hereby incorporated by reference in its entirety. In some embodiments, the extensible end cap within the disclosed headrail may include a mounting bracket which may be placed adjacent to a window frame or door frame when the headrail is mounted. A piston may be positioned to apply force to the mounting bracket to keep the headrail in position within the window frame or door frame. A floating bearing may apply pressure to the piston causing the piston to extend toward the mounting bracket. Consequently, when the floating bearing pushes against the piston, the piston transmits the force to the mounting bracket, thus holding the headrail in place.

The end cap may include a sensor that detects how much force is applied to the end cap system. In some embodiments, the sensor may be either a pressure sensor and a force sensing resistor. In embodiments in which the sensor is a pressure sensor, the pressure sensor may be a strain gage pressure transducer, variable capacitance pressure transducer, a piezoelectric pressure transducer, or other pressure sensor known in the art.

The headrail also includes a gearbox which may adjust the headrail mounting when the sensor collects a measurement that suggests the mounting is beginning to fail. The gearbox may be placed within the headrail. It may include a motor which is coupled to a main gear. The motor may cause the main gear to rotate. Some embodiments also include one or more additional stages of gears. The additional stages of gears may be mechanically coupled to the main gear and may function to reduce the gear ratio of the motor. The main gear and the additional stages of gears may include external teeth which may mesh with each other to turn the gears.

A threaded rod with an external thread may be within the gearbox. The external threads may mesh with the external teeth of the main gear. Consequently, when the motor drives the main gear, the main gear rotates causing the threaded rod to rotate. When the threaded rod rotates, it may move in a linear manner in the direction that is parallel with the length of the threaded rod. The threaded rod may move toward the floating bearing and come in direct or indirect contact with the floating bearing. The coupling of the threaded rod to the floating bearing may cause the threaded rod to apply force to the floating bearing. This force is transmitted through the piston, causing the piston to compress against the mounting bracket. The mounting bracket becomes more tightly pressed against the window frame or door frame. The headrail mounting is thereby tightened making a more secure mounting.

In some embodiments, the threaded rod includes a base and a connector on the end of the threaded rod that is coupled to the floating bearing. In some embodiments, the connector may come in direct contact with the floating bearing. The connector may be wider than the threaded rod which allows the force the threaded rod applies to the floating bearing to be dispersed over a greater surface area. This may cause the floating bearing to move toward the piston in a smoother, mores stable manner. In some embodiments, a base joins the connecter to the end of the threaded rod. The base may be slidably connected to a track within the gearbox. The base may slide along the gearbox as the threaded rod moves toward or away from the floating bearing. The base connected to the track may steady the threaded rod and also provide a smoother motion toward the floating bearing.

In some embodiments, the gearbox includes a battery. The battery may provide power to the motor. In some embodiments, the battery may be placed within the gearbox housing. In other embodiments, the battery may be positioned outside of the gearbox and wired to connect electrically to the motor.

In some embodiments, the headrail includes a controller. The controller may be electrically connected to both the sensor and to the motor. The controller may include a memory that includes program code. The program code may include instructions that interpret signals received from the sensor which represent measurements of pressure or force applied to the mounting bracket. When the measurement is below a defined level of force or pressure, the program code may send a signal to the motor causing the motor to actuate. By actuating the motor, the one or more gears rotate causing the threaded rod to rotate and move linearly. The headrail mounting may then be tightened as described above.

In some embodiments, the defined level of force or pressure which may trigger the mechanism to tighten the headrail mounting may be stored in the controller's memory. In some examples, the defined level may be between about 50 pounds and about 200 pounds of force. In other examples, the defined level may be between about 70 and about 200 pounds of force. In yet another example, the defined level may be about 150 pounds of force.

In some embodiments, the controller includes a data transmission port. The data transmission port may be in connection with both the controller and a remote device. Consequently, data and other information may be transmitted between the remote device and the controller. For example, the remote device may send a transmission to the controller which tells the controller what the defined level of force or pressure the sensor must measure to cause the gear box to initiate the actions which tighten the headrail mounting.

In some embodiments, the transmission may be a wireless transmission through a wireless device. The wireless device may include a Bluetooth device. The remote device may be a user's mobile device. Consequently, the user may adjust the value of the defined level of force or pressure that triggers the headrail to adjust the mounting.

In some situations, it may be useful for a user to know the values of the sensor readings and how frequently and how often the gearbox adjusts the headrail mounting. This information may be useful to indicate with the parts of the end cap are beginning to wear and need repair or replacement. Accordingly, in some embodiments of the disclosed headrail, the memory in the controller stores data describing the values of the sensor readings and the dates signals to actuate the motor occurred. The controller may access this data and send a transmission to a remote device when the controller has actuated the motor to adjust the headrail mounting a defined number of times. The controller may send the data to the remote device which may occur through a wireless transmission. The remote device may also transmit data to the controller which may include the number and frequency of headrail adjustments that may occur before sending a report to the remote device. As discussed above, the remote device may be a user's mobile device.

Referring now to the drawings, FIG. 1A shows end cap 100 with the piston in a retracted position as may occur before the headrail is mounted in a window frame. Floating bearing 140 is shown in first position 130 which results in the retracted position of end cap 100. Threaded rod 105 is also retracted at this point. As threaded rod 105 rotates, it moves linearly in the direction that is parallel with the length of threaded rod 105 (toward the left side of the drawing). In the embodiment of FIG. 1A, threaded rod 105 includes base 110 which may move along track 117. This interaction provides stability to threaded rod 105 as it moves forward and results in a smoother movement. Threaded rod 105 may rotate within base 110 so that base 110 does not also rotate. Base 110 is shown coupled to connecter 115 which comes in direct contact with floating bearing 140. This design provides a greater surface area through which to transfer pressure from threaded rod 105 to floating bearing 140.

When threaded rod 105 moves toward floating bearing 140 and connector 115 contacts floating bearing 140, force is applied to floating bearing 140. This force compresses springs 150 which are wound around guide pins 160. Springs 150 are part of the piston which transmits force to mounting bracket 180. The compression creates force that is transmitted to mounting bracket 180. The force may hold the headrail in place within the window frame. Pressure sensor 190 may detect the force that is being exerted on mounting bracket 180 and communicate that measurement to a controller as described previously herein.

Figure 1B:
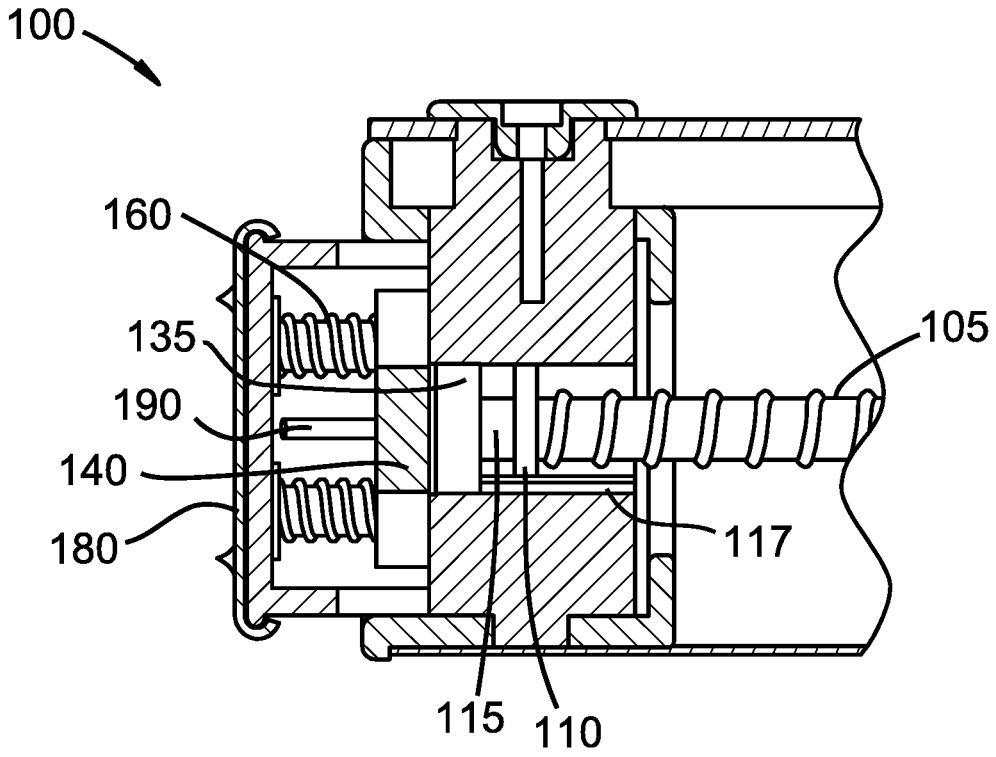
FIG. 1B illustrates the extensible end cap of FIG. 1A with the piston in an extended position.

FIG. 1B shows end cap 100 with the piston in an extended position as it may be when the headrail is mounted in a window frame. Threaded rod 105 has been rotated and moved forward (left in the drawing). This movement forces floating bearing 140 to move to second position 135 which places it nearer mounting bracket 180. Springs 150 compress creating force against mounting bracket 180 which holds the headrail in the window frame.

Pressure sensor 190 is shown in both FIGS. 1A and 1B. In this embodiment, pressure sensor 190 is positioned between floating bearing 140 and mounting bracket 180 so as to sense the change in pressure between the two parts. In FIG. 1A, end cap 100 is in a retracted position so pressure sensor 190 will sense little pressure. In contrast, in FIG. 1B, end cap 100 is in an extended position. Assuming the headrail is mounted within a window frame in FIG. 1B, pressure sensor 190 will sense an increased amount of pressure relative to FIG. 1A.

Figure 2:
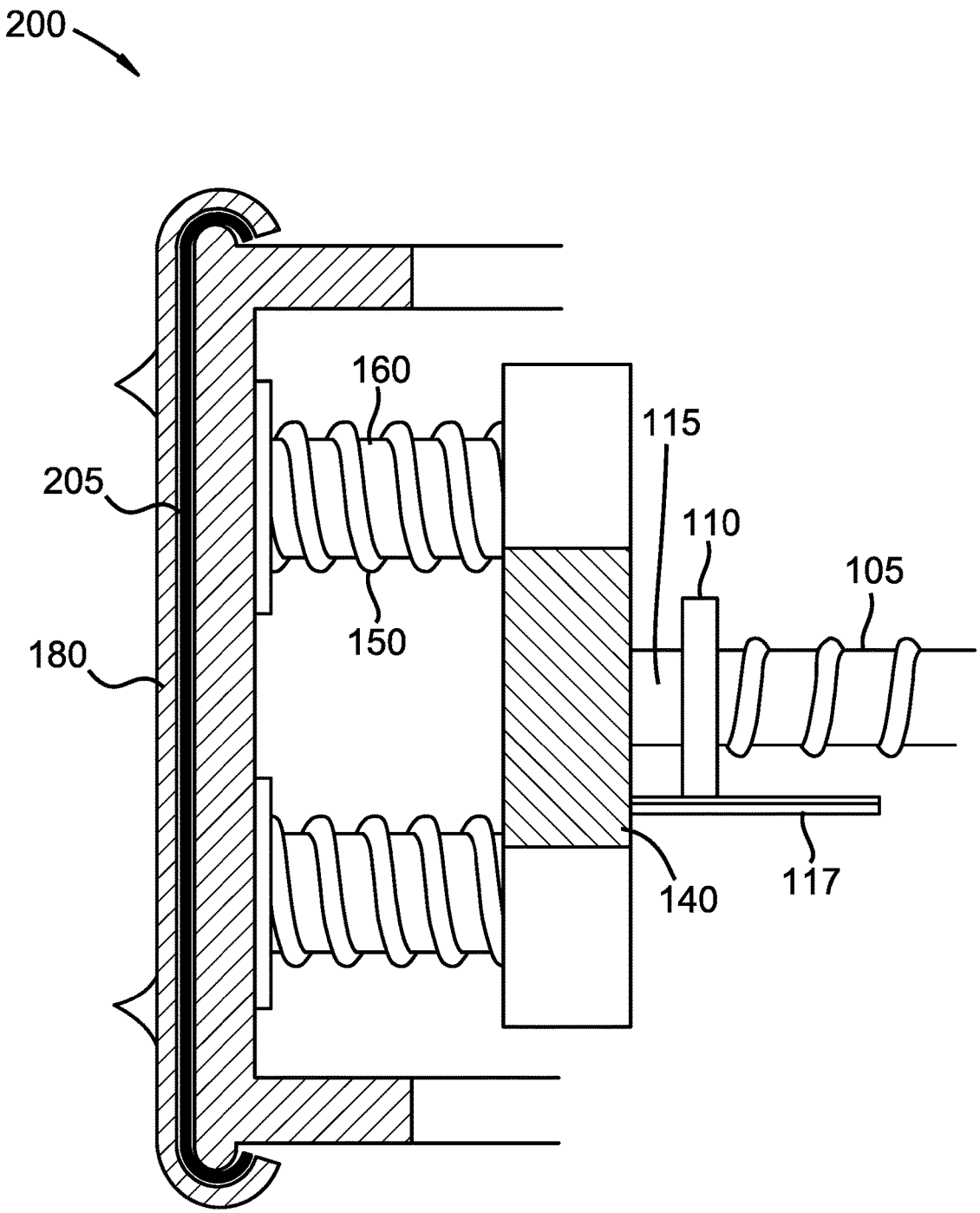
FIG. 2 illustrates a perspective view of a cross-section of an embodiment of an extensible end cap with the threaded rod, base, and connector shown.

FIG. 2 illustrates end cap 200 which shows floating bearing 140 applying force to springs 150 which are wound around guide pins 160. The force is transferred to mounting bracket 180. End cap 200 further includes force sensing resistor 205 which, in this embodiment, is a thin layer beneath mounting bracket 180. Force sensing resistor 205 detects the force applied to mounting bracket 180, which will be greater when threaded rod 105 is in an extended position than when it is in a retracted position. In this embodiment of the invention, threaded rod 105 is attached to base 110 and slidably connected to track 117. Connector 115 is attached to base 110 and may apply pressure on floating bearing 140 when end cap 200 is in an extended position.

Figure 3:
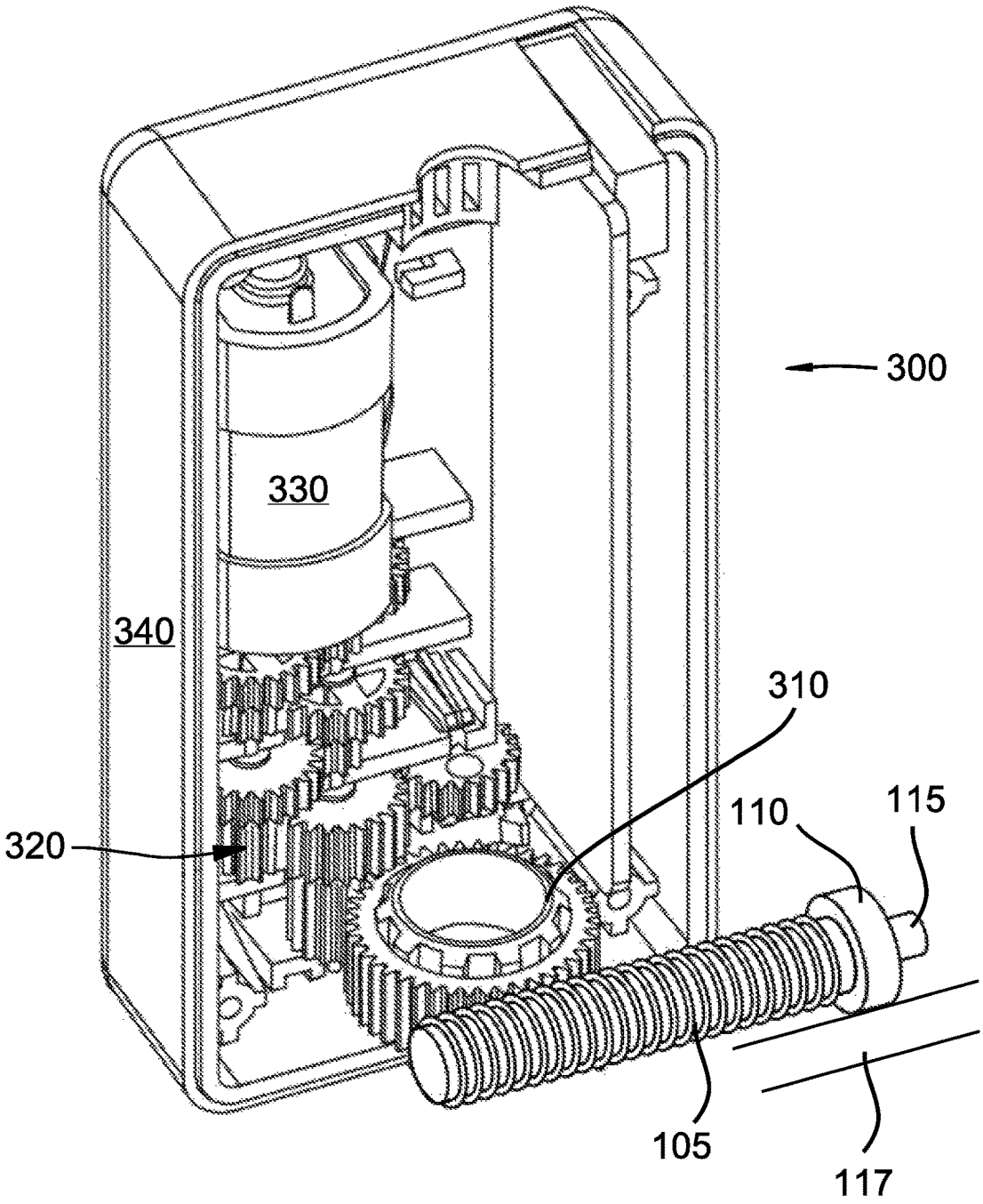
FIG. 3 illustrates perspective view of a gearbox according to an embodiment of the disclosure.

FIG. 3 shows gearbox 300 according to an embodiment of the disclosure, which may adjust the headrail mounting when the sensor collects data that suggests that the mounting is beginning to fail. Gearbox 300 includes housing 340 which contains mechanical components and provides structure. It also comprises motor 330, which is coupled to a main gear 310 and provides the power to rotate main gear 310. In this embodiment, motor 330 is directly coupled to power transmission system 320 which includes multiple stages of gears and which reduces the gear ratio of the motor. As shown, power transmission system 320 and main gear 310 mesh together through interlocking external teeth. Threaded rod 105 is mechanically coupled to main gear 310 such threaded rod 105 rotates when main gear 310 is actuated by motor 330. This allows threaded rod to move forward or backward, parallel to track 117. Base 110 may be coupled to track 117 to guide this forward and backward movement. Connector 115 is attached to base 110. Connector 115 provides a wider surface than the end of threaded rod 105 so as to disperse the force transmitted from threaded rod 105 to a floating bearing within an extensible end cap.

Figure 4:
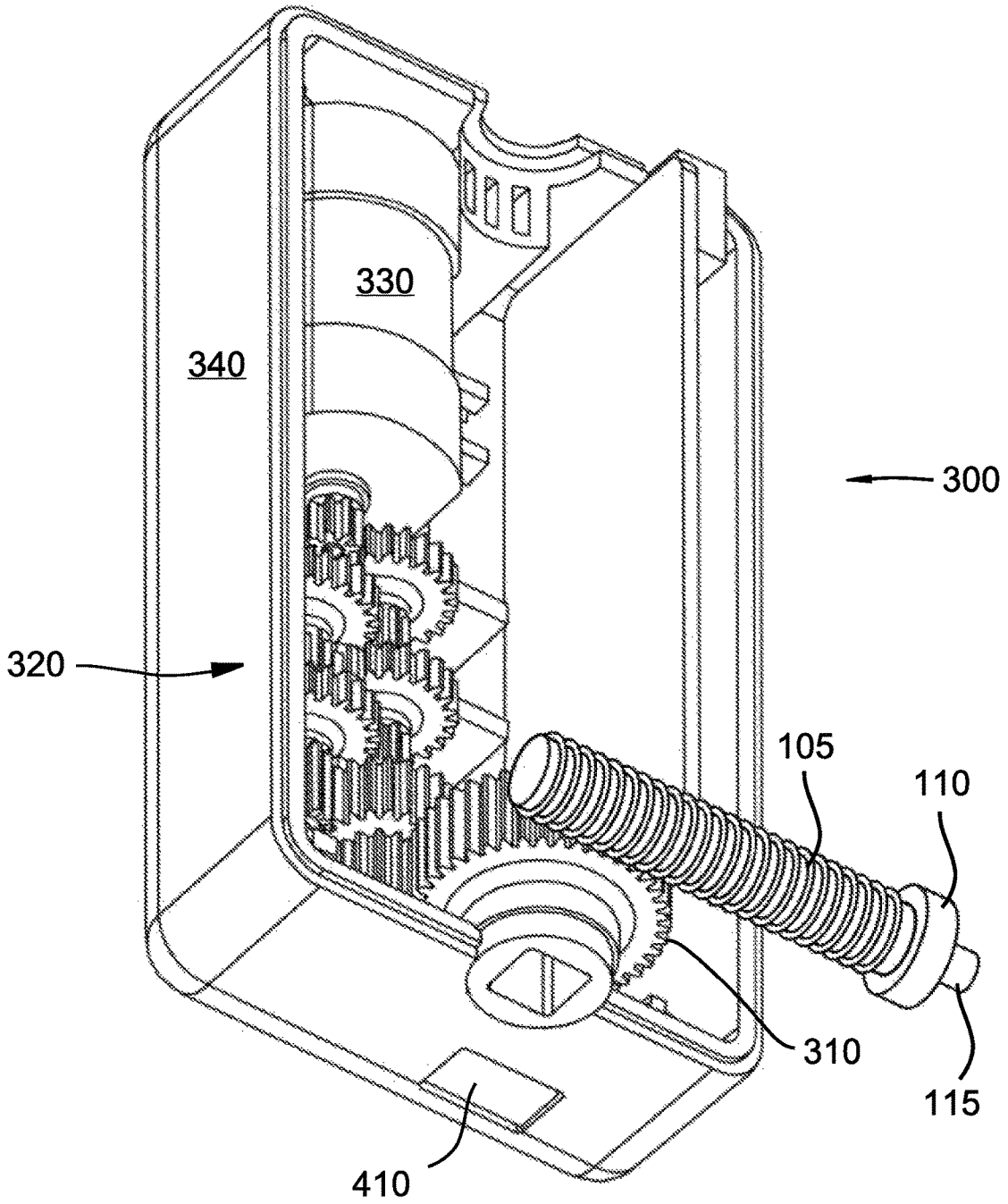
FIG. 4 illustrates a perspective view of the gearbox of FIG. 3 viewed from an alternate angle.

FIG. 4 shows gearbox 300 as in FIG. 3. In this embodiment, output port 410 is shown which may permit a connection from motor 330 to an external battery to enter gearbox 300.

Figure 5A:
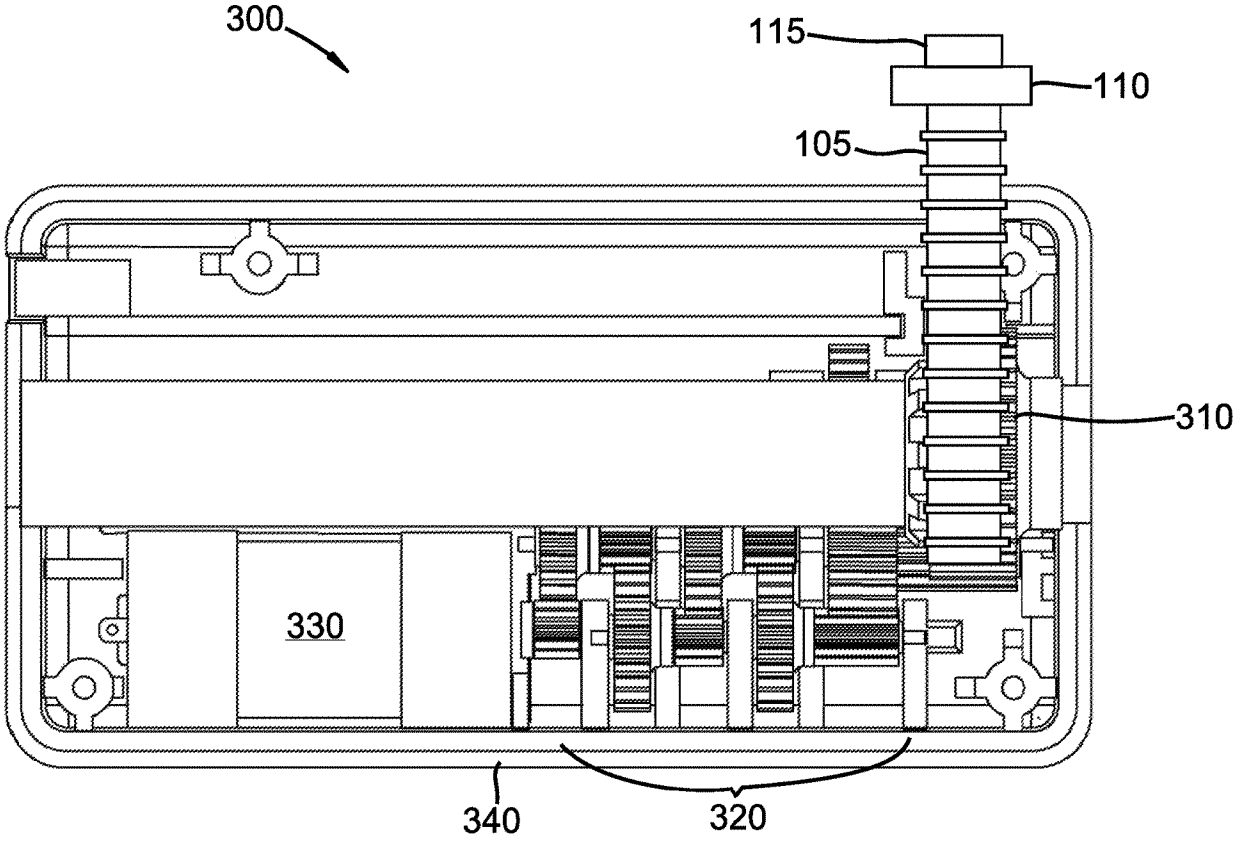
FIG. 5A illustrates an aerial perspective view of a gearbox of FIG. 3.
Figure 5B:
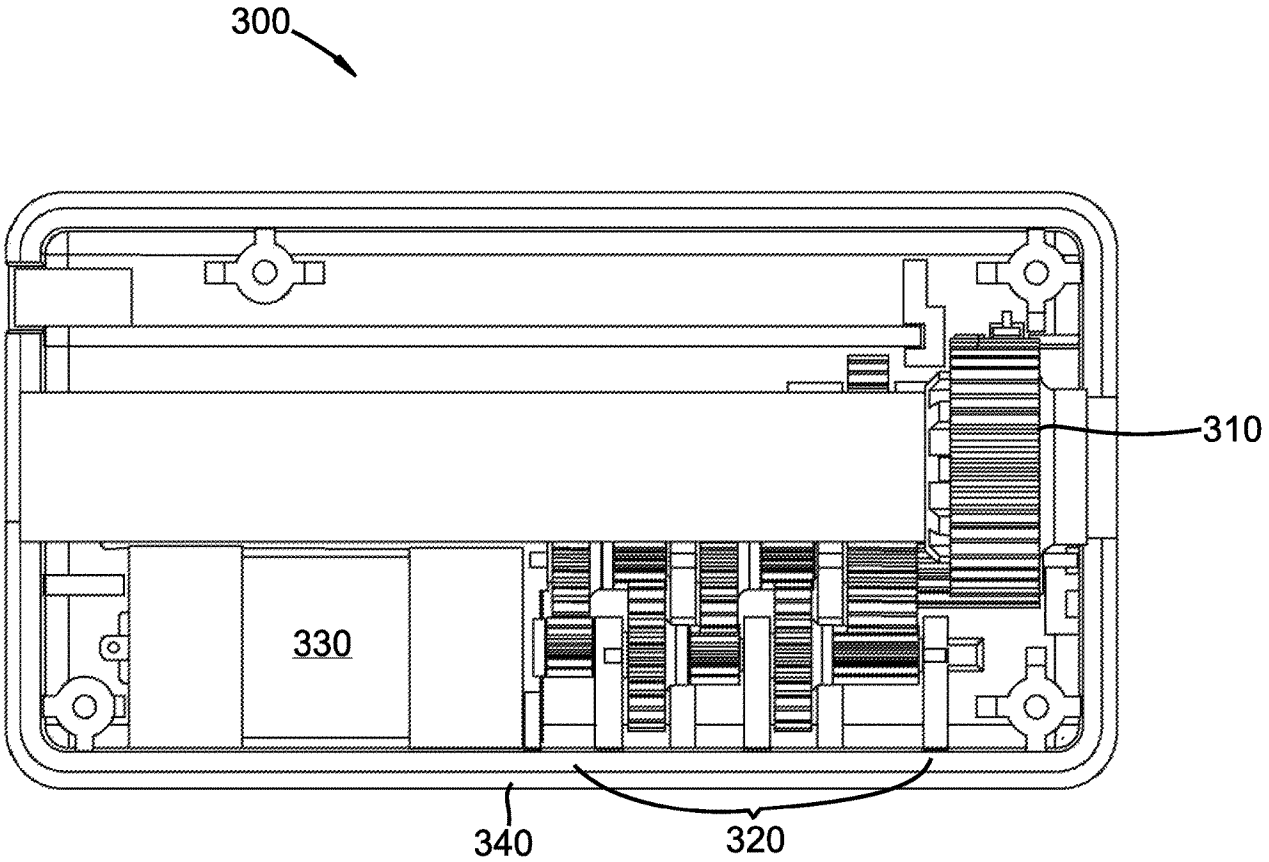
FIG. 5B illustrates the gearbox of FIG. 5A with the threaded rod, base, and connector removed for clarity.

FIGS. 5A and 5B illustrate gearbox 300 from an aerial perspective. FIG. 5A includes threaded rod 105, base 110, and connector 115. Threaded rod 105 is shown with its threads meshed with the external teeth of main gear 310. FIG. 5B excludes threaded rod 105, base 110, and connector 115 to more clearly show main gear 310.

Figure 6:
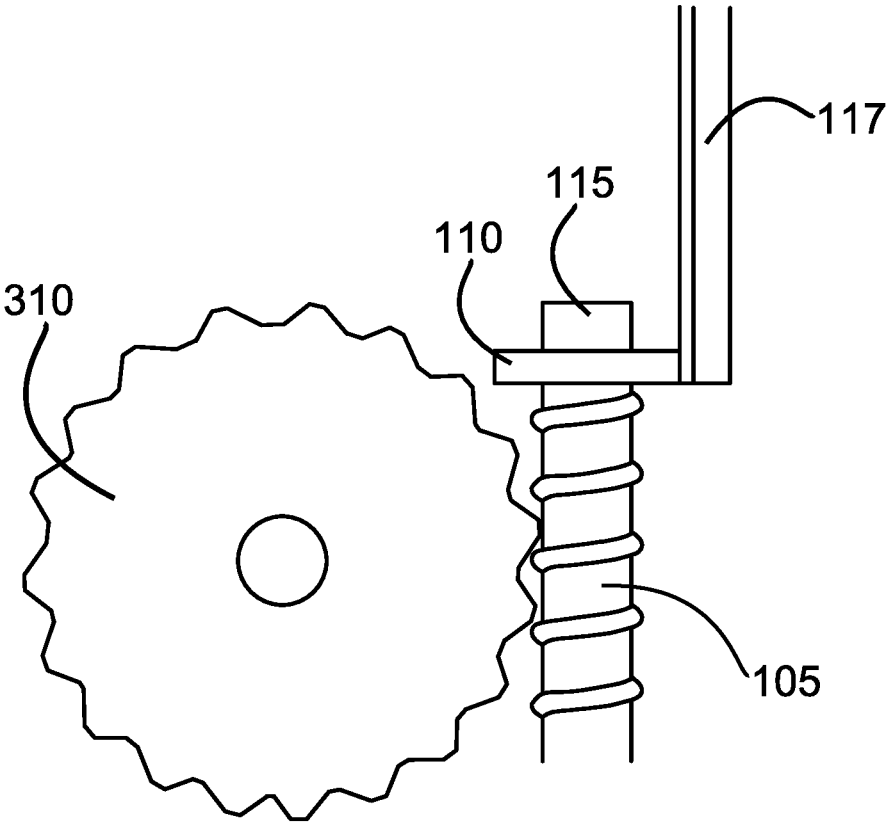
FIG. 6 illustrates a perspective view of the main gear and threaded rod.

FIG. 6 shows main gear 310 with external teeth meshed with the thread of threaded rod 105. Threaded rod 105 is connected to base 110, which is slidably connected to track 117. As shown, when main gear 310 rotates, threaded rod 105 moves in a direction that is parallel with track 117 and base 110 slides along track 117. Connector 115 eventually contacts a floating bearing in an extensible end cap to exert force on the piston and thereby exert force on the window frame in which the headrail is installed.

Figure 7:
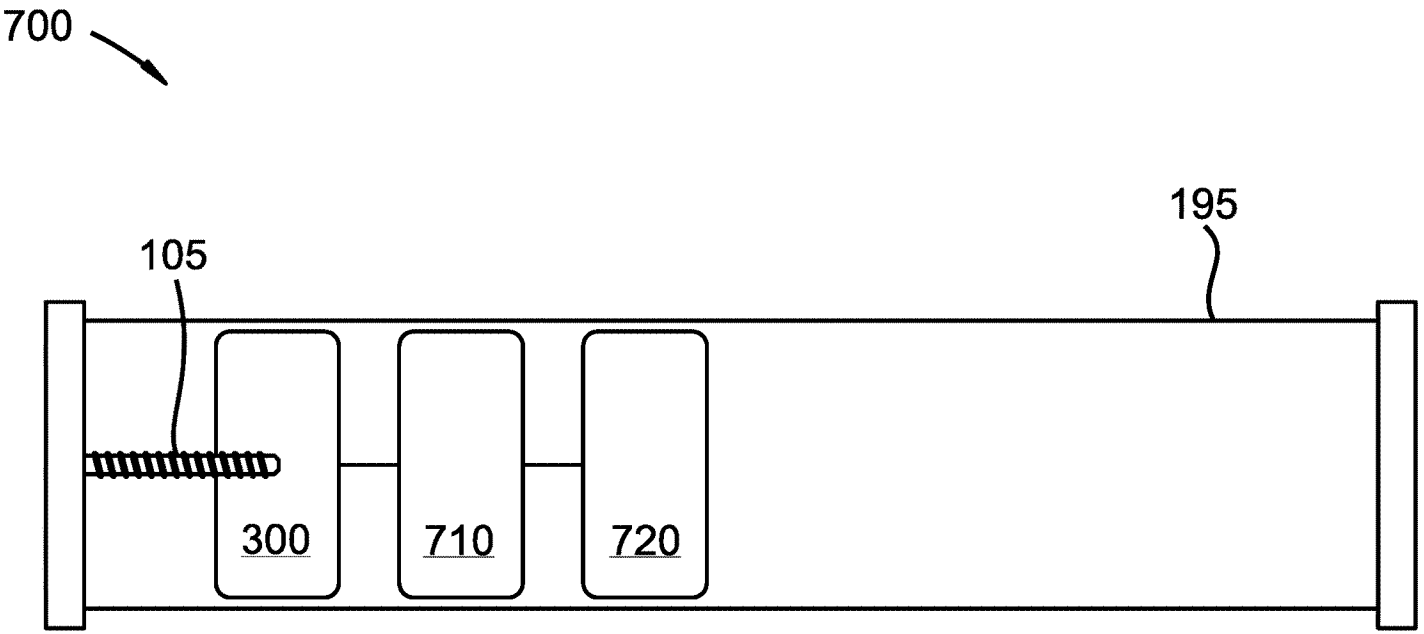
FIG. 7 illustrates cross-sectional perspective view of an embodiment of the disclosed headrail.

FIG. 7 illustrates embodiment 700 of the disclosed invention, comprising headrail 195. Gear box 300 is shown electrically connected to battery 710 and batter 710 is connected to controller 720, all of which are shown within headrail 195. In embodiment 700, the electrical connections are shown with wires depicted as horizontal lines. Threaded rod 105 is shown extending from gear box 300 to exert force on the end cap.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A headrail for a window covering comprising:

an extensible end cap comprising:

a mounting bracket;

a piston, wherein the piston is connected to the mounting bracket;

a floating bearing, wherein the floating bearing is connected to the piston;

a sensor for measuring the amount of pressure or force applied to the piston;

a gearbox, wherein the gearbox is disposed within the headrail, the gearbox comprising:

a motor;

a main gear comprising a plurality of external teeth, wherein the main gear is coupled to the motor;

a threaded rod comprising an external thread, wherein the plurality of external teeth of the main gear mesh with the external thread, wherein the threaded rod is coupled to the floating bearing; and a controller, wherein the controller is electrically connected to the sensor and to the motor.

2. The headrail of claim 1, wherein the threaded rod further comprises a connector, and a base, and wherein the gearbox further includes a track, wherein the base is coupled to an end of the threaded rod, wherein the base is slidably connected to the track, and wherein the connector is coupled to the base.

3. The headrail of claim 1, further comprising at least one additional stage of gears, wherein the at least one stage of gears is mechanically coupled to the main gear.

4. The headrail of claim 1, further comprising a battery, wherein the battery is in electronical coupled to the motor.

5. The headrail of claim 1, wherein the sensor consists of one of the following: a pressure sensor and a force sensing resistor.

6. The headrail of claim 5, wherein the sensor comprises a pressure sensor, wherein the pressure sensor is selected from the following: a strain gage pressure transducer, variable capacitance pressure transducer, and piezoelectric pressure transducer.

7. The headrail of claim 1, wherein the controller comprises a memory, and wherein the memory comprises program code.

8. The headrail of claim 7, wherein the controller transmits signals that cause the motor to actuate through the electrical connection between the controller and the motor when the sensor detects a measurement below a defined level.

9. The headrail of claim 8, wherein the defined level is between about 50 pounds and about 200 pounds of force.

10. The headrail of claim 8, wherein the defined level is between about 70 and about 200 pounds of force.

11. The headrail of claim 8, wherein the defined level is about 150 pounds of force.

12. The headrail of claim 8, wherein the defined level is stored in the memory.

13. The headrail of claim 8, further comprising a data transmission port, wherein the data transmission port is coupled to the controller and to a remote device.

14. The headrail of claim 13, wherein the controller receives a transmission from the remote device through the data transmission port which specifies the defined level required to actuate the motor.

15. The headrail of claim 14, wherein the transmission is a wireless transmission.

16. The headrail of claim 14, wherein the remote device is a mobile device.

17. The headrail of claim 8, wherein the memory stores a data set describing sensor readings and dates of the transmissions from the controller to the motor that cause the motor to actuate.

18. The headrail of claim 17, wherein the controller sends a transmission to a remote device when the controller has actuated the motor a defined number of times.

19. The headrail of claim 18, wherein the transmission is a wireless transmission.

20. The headrail of claim 18, wherein the remote device is a mobile device.

* * * * *